United States Patent [19]

Stemmle

[11] Patent Number: 4,919,409

[45] Date of Patent: Apr. 24, 1990

[54] SHEET HANDLING APPARATUS WITH NARROW BELT HAVING RAISED FRICTIONAL CONTACT ELEMENT

[75] Inventor: Denis J. Stemmle, Webster, N.Y.

[73] Assignee: Xerox Corporation, Stamford, Conn.

[21] Appl. No.: 882,120

[22] Filed: Jul. 3, 1986

[51] Int. Cl.[5] ..... B65H 3/04; B65H 5/02; B65H 9/04

[52] U.S. Cl. ..... 271/34; 271/245; 271/275

[58] Field of Search ..... 271/34, 118, 236, 245, 271/246, 117, 35, 119, 275, 167; 355/75, 38 H, 148 H; 198/728

[56] References Cited

U.S. PATENT DOCUMENTS

| | | | |
|---|---|---|---|
| 3,485,489 | 12/1969 | Lindquist | 271/34 X |
| 3,703,626 | 11/1972 | Shanrock | 271/275 X |
| 3,734,490 | 5/1973 | Parks | 271/34 |
| 3,863,912 | 2/1975 | Korff | 271/245 |
| 3,885,783 | 5/1975 | Anderson | 271/34 |
| 3,915,447 | 10/1975 | Perno | 271/7 |
| 3,949,979 | 4/1976 | Taylor et al. | 271/117 X |
| 4,074,902 | 2/1978 | Bradbury | 271/34 |
| 4,076,233 | 2/1978 | Knight et al. | 271/233 |
| 4,146,219 | 3/1979 | Phillips | 271/233 |
| 4,146,220 | 3/1979 | Barton | 271/233 |
| 4,146,326 | 2/1979 | Taylor et al. | 271/246 X |
| 4,169,674 | 10/1974 | Russel | 271/245 X |
| 4,350,332 | 9/1982 | Knight | 271/188 |
| 4,487,407 | 12/1984 | Baldwin | 271/233 |
| 4,674,734 | 6/1987 | Ibuchi | 271/117 X |

FOREIGN PATENT DOCUMENTS

| | | |
|---|---|---|
| 58-024169 | 5/1980 | Japan . |
| 55-073951 | 5/1980 | Japan . |
| 57-11533 | 1/1982 | Japan . |

OTHER PUBLICATIONS

IBM Technical Disclosure Bulletin: vol. 8; No. 10; Mar. 1966; p. 1423.

IBM Technical Disclosure Bulletin: vol. 19; No. 3; Aug. 1976; pp. 746–747.

*Primary Examiner*—Joseph J. Rolla

*Assistant Examiner*—Edward S. Ammeen

[57] ABSTRACT

Sheet handling apparatus for separating sheets from a stack and transporting, registering and deskewing individual separated sheets, includes a single endless narrow width belt movably supported around at least two support rolls defining a path for sheet separation/feeding station through a sheet transport run to a sheet registration station. The single narrow width belt has at least one raised frictional contact element on its outer run for frictional engagement with a sheet to separate a sheet from a sheet separation station and transport it across an imaging platen to a registration station, single frictional contact element provides a single pivot about which a sheet may pivot when it reaches the registration stop member to be deskewed. In an alternative embodiment the device is used simply for transporting, registering and deskewing sheets.

15 Claims, 5 Drawing Sheets

SHEET HANDLING APPARATUS WITH NARROW BELT HAVING RAISED FRICTIONAL CONTACT ELEMENT

BACKGROUND OF THE INVENTION

This invention relates to sheet handling apparatus for separating sheets from a stack and transporting, registering and deskewing individual separated sheets. In a particular application, it is directed to use of such sheet handling apparatus as an automatic document feeder in electrostatographic printing apparatus.

In an electrostatographic reproducing apparatus commonly in use today, a photoconductive insulating member is typically charged to uniform potential and thereafter exposed to a light image of an original document to be reproduced. The exposure discharges the photoconductive insulating surface in exposed or back ground areas and creates an electrostatic latent image on the member which corresponds to the image areas contained within the usual document. Subsequently, the electrostatic latent image on the photoconductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas in the photoconductive insulating area to form a powder image on the photoconductive area. This image may subsequently be transferred to a support surface such as copy paper to which it may be permanently affixed by heating or by the application of pressure.

In order to increase the throughput and other reproducing capabilities it is common practice to use document handlers with automatic electrostatographic reproducing apparatus. The document handlers are used to separate individual documents from a stack of documents to be copied, move them on to the viewing platen where they are registered, held until the required number of copies have been made and then moved onto an output collection point to be followed by successive documents in the stack. Such an automatic document handler must not only move the document but must accurately register it in a predetermined copying position to assure production of a complete and visually acceptable copy. If, for example, the document is situated on the platen in a skewed or misaligned position, the copy will reflect the same skew or misalignment. Furthermore, it must also be capable of accepting a maximum range of paper weights or material weights efficiently as documents copied may have to vary from very heavy papers to very light papers such as those known as onion skin. In addition, it is important that the automatic document handler have the ability to readily accommodate manual documents such as books which necessitates that the viewing platen be cleared and easily accessible to the operator for such operations.

Typically document handlers that have been used in the prior art include those employing a wide friction belt to transport the documents across the viewing platen. These devices, however, have relatively limited latitude because the normal force that is required to ensure that the document can be driven across the platen glass is present across the whole document. That is the same normal force is applied at the leading edge, center and the trail edge of the document. This uniform normal force tends to inhibit deskewing of the document once its lead approaches the registration edge since the uniform normal force tends to inhibit the document from rotating laterally. Furthermore, since the friction drive force must always be sufficient to drive the document across the platen, unless that force is reduced it can buckle or damage lighter weight documents while driving them into the registration edge. In addition, these devices suffer from further difficulty in that they are relatively expensive to manufacture, which is a critical element today in the design, manufacture and marketing of automatic reproducing machines designed for low copy rate or low volume production. Most of the automatic document feeders that are used for the low volume segment use friction retard separation devices which are relatively unpredictable in that the exact period of time between separation and when the document is fully being transported is uncertain. Accordingly, these systems typically have a separator feed roll actuated by an expensive clutch together with clutched takeaway rolls and a sensor to determine when the document is well on a controlled path. Such a device is relatively expensive in that motor, clutches and bearings together with the sensor are all required in order to ensure controlled feeding of the document.

PRIOR ART

An early type document feeder is that described in U.S. Pat. No. 3,863,912 (Korff) which describes and illustrates a document feeder comprising an endless belt of a thin, opaque flexible material formed in a continuous loop with a plurality of parallel ridges extending longitudinally of the belt around its outer periphery for frictional engagement with an original document to enable the transferring and holding of the original document. The belt moves the document across the platen into a position where it is retained by a registration gate which engages one end of the document until the desired number of copies are produced. When the gate is moved to the open position, the document is discharged and the next document is fed into place for copying.

U.S. Pat. No. 4,076,233 (Knight et al.) and U.S. Pat. No. 4,146,219 (Phillips) both illustrate document handling apparatus employing single endless narrow width belt to transport the documents across the viewing platen, back them up against the registration edge and after completing the necessary copying function, transporting them in a forward direction once again off the viewing platen. The Rank Xerox "7000" document feeder is similar to that illustrated in these two patents.

In U.S. Pat. No. 4,076,233 (Knight et al.) the belt has a support means approximately in the center of the viewing platen so that it provides two separated contact areas with the platen along the length of the belt, one on each side of the intermediate support means. This provides two contact areas of about two to three inches in length. It is stated at column 5, beginning at line 21 that "The separated contact areas have the advantage that the area of frictional engagement between the belt means and the document may be set to assure a good grip of the document by the belt as it is being moved onto the platen 12, but yet allowing pivoting of the document in a generally central area as shown in FIG. 4 so that any skew may be corrected when the document is moved by the belt against the registration member 40. With a full width belt, frictional contact between the document and the belt tends to be so great that no amount of skew of the document can be corrected on registration and the document will buckle".

U.S. Pat. No. 4,146,219 (Phillips) describes a similar apparatus which further includes a variable friction producing means for providing a high frictional engagement between the single endless narrow width belt and the document when the belt is moving the document in the first direction onto the viewing platen and a relatively low frictional engagement when the belt reverses direction and moves the document in a second direction towards the registration edge. This reduction in frictional force enables any skew in the document to be properly corrected.

The Fuji Xerox 4800 SADH has an automatic document handler wherein the feed belt extends across the width of the platen but has bumps molded into the belt across the width of the belt. The belt movement is synchronized so that the bumps provide normal force only across the lead edge of the document. While improving the feeding latitude considerably this device still provides a high normal force on the lead edge of the document which tends to reduce the desired deskewing when fed to the registration edge and may in some instances, lead to damage to the lead edge of the document. A similar device is present in the SADH on the Xerox 1055.

U.S. Pat. No. 3,915,447 (Perno) describes a horizontal platen belt transport wherein a moveable endless belt has a plurality of flexible tabs formed thereon projecting substantially perpendicularly from the belt surface and extending across the belt in a direction perpendicular to the direction of belt travel. The sheet supply means overdrives the sheet material against the tabs to cause the sheet to be deskewed there against and movement of the belt relative to the support means causes the tabs to be deformed toward the surface of the belt to positively grip the lead edge of the sheet material between the tab and the belt surface.

SUMMARY OF THE INVENTION

In accordance with a principal aspect of the present invention, sheet handling apparatus is provided for transporting, registering, and deskewing sheets which comprises a flat surface across which sheets may be transported, a registration stop member at the outboard end of the flat surface, a single endless narrow width belt movably supported around at least two support rollers to define a belt transport run across and parallel to the flat surface such single narrow width belt having at least one raised frictional contact element on its outer run for frictional transporting engagement with a sheet to be transported across the flat surface toward the registration stop member, said raised frictional contact elements on said belt being spaced apart by a distance more than the maximum dimension of a sheet to be transported so that a sheet being transported across said flat surface towards said registration member is transported by frictional contact only with one of said frictional contact elements thereby providing a single pivot about which a sheet may pivot when it reaches the registration stop member to be deskewed.

In a further aspect of the present invention, the raised frictional contact elements projects substantially normally to the belt surface and the flat surface comprises a substantially horizontal imaging platen of an electrostatographic printing machine.

In a further aspect of the present invention, the sheet handling apparatus includes means to recriprocally move the registration stop member from a registration position to a position retracted from said registration position.

In a further aspect of the present invention, the raised frictional contact element on the single endless narrow width belt ejects the leading edge of the sheets from the flat surface when the registration stop member is in a retracted position and the sheet handling apparatus further includes sheet take away rolls, a sheet turn baffle, sheet eject rolls and a sheet stacking tray on top of the belt transport run.

In a further principal aspect of the present invention, a sheet handling apparatus is provided for separating sheets from a stack and transporting, registering, and deskewing individual separated sheets which comprises a single endless narrow width belt movably supported around at least two support rollers defining a path from a sheet separation/feeding station through a sheet transport run to a sheet registration station, said single narrow width belt having at least one raised frictional contact element on its outer run for frictional engagement with a sheet, a sheet stack support platform at the sheet separation/feeding station, a friction retard pad on said support platform and under the separation/feeding station of said belt forming a sheet separating nip therebetween, a flat surface across which separated sheets may be transported, a registration stop member at the outboard end of said flat surface, means to reciprocally support one of said support rollers at the sheet separation station between a sheet separation position wherein a raised frictional contact element on said belt contacts the top sheet of a stack of sheets when a stack of sheets is present and a position retracted from the sheet separation position, said raised frictional contact elements on said belt being spaced apart by a distance more than the maximum dimension of a sheet being separated, transported and registered so that a sheet being separated from a stack of sheets is contacted at said separation nip by only one of said frictional contact elements and is transported across the flat surface towards the registration member by the same frictional contact element thereby providing a single pivot about which a sheet may pivot when it reaches the registration stop member to be deskewed.

In a further aspect of the present invention, the means to reciprocally move said support roller and registration member are interconnected so that when said support roller is in the separation/feeding position the registration member is in the retracted position.

Other features in the present invention will become apparent as the following description proceeds upon reference to the following drawings.

DESCRIPTION OF THE PREFERRED EMBODIMENT

The invention will now be described with reference to the preferred embodiment of the sheet handling apparatus in an electrostatographic apparatus employing same.

Figure 1:
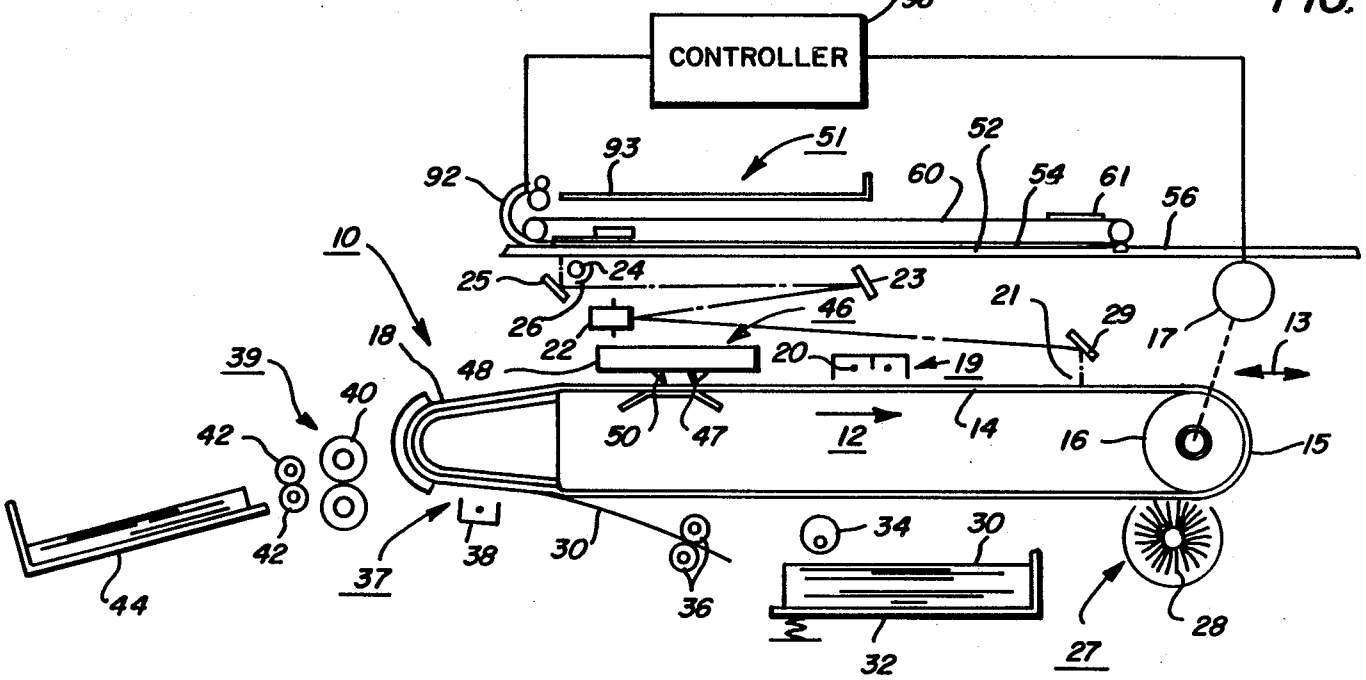
FIG. 1 is a schematic representation in cross section of an automatic electrostatographic reproducing machine with the sheet handling apparatus according to the present invention.

Referring now to FIG. 1 there is shown by way of example, an automatic electrostatographic reproducing machine 10 which includes the sheet handling apparatus according to the present invention. The reproducing machine depicted in FIG. 1 illustrates the various components utilized therein for producing copies from an original document. Although the apparatus of the present invention is particularly well adapted for use in automatic electrostatographic reproducing machines, it should become evident from the following description that it is equally well suited for use in a wide variety of processing systems including other electrostatographic systems and is not necessarily limited in application to the particular embodiments shown herein.

The reproducing machine 10 illustrated in FIG. 1 employs a removable processing cartridge 12 which may be inserted and withdrawn from the main machine frame in the direction of arrow 13. Cartridge 12 includes an image recording belt like member 14 the outer periphery of which is coated with a suitable photoconductive material 15. The belt is suitably mounted for revolution within the cartridge about driven transport roll 16, around belt tracking shoe 18 and travels in the direction indicated by the arrow on the inner run of the belt to bring the image bearing surface thereon past the plurality of xerographic processing stations. Suitable drive means such as motor 17 are provided to power and coordinate the motion of the various cooperating machine components whereby a faithful reproduction of the original input scene information is recorded upon a sheet of final support material 30, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image. The optical system 21 is operated to produce a copy of a document 52 which is placed image side down upon horizontal viewing platen 54. Reproduction is accomplished by the full rate mirror 25 scanning the entire original document. Positioned together with the full rate scanning mirror 25 are the illuminating lamp 24 and the object reflector 26. As the full rate mirror 25 scans the original document on the platen, the half rate mirror 23 moves at one half the rate of the full rate mirror to maintain the object to lens conjugate equal to the lens to image conjugate of the system. Light rays from the object are reflected from the half rate mirror 23 to the half lens system 22 which collects light from the input side of the lens and forms an image after being reflected from the photoreceptor mirror 29 at the imaging station on the photoreceptor belt. The speed of the scanning full rate and half rate mirrors and the speed of the photoconductive belt are synchronized to provide a faithful reproduction of the original document on the belt. After exposure of the belt 14 the electrostatic latent image recorded on the photoconductive surface 15 is transported to development station 27, wherein developer is applied to the photoconductive surface 15 of the belt 14 rendering the latent image visible. Suitable development station could include a magnetic brush development system including developer roll 28, utilizing a magnetizable developer mix having course magnetic carrier granules and toner colorant particles.

Sheets 30 of the final support material are supported in a stack arrangement on elevated stack support tray 32. With the stack at its elevated position, the sheet separator segmented feed roll 34, feeds individual sheets therefrom to the registration pinch roll pair 36. The sheet is then forwarded to the transfer station 37 in proper registration with the image on the belt and the developed image on the photoconductive surface 15 is brought into contact with the sheet 30 of final support material within the transfer station 37 and the toner image is transferred from the photoconductive surface 15 to the contacting side of the final support sheet 30 by means of transfer corotron 38. Following transfer of the image, the final support material which may be paper, plastic, etc., as desired, is separated from the belt by the beam strength of the support material 30 as it passes around the arcuate face of the belt tracking shoe 18, and the sheet containing the toner image thereon is advanced to fixing station 39 wherein roll fuser 40 fixes the transferred powder image thereto. After fusing the toner image to the copy sheet, the sheet 30 is advanced by output rolls 42 to sheet stacking tray 44.

Although a preponderance of toner powder is transferred to the final support material 30, invariably some residual toner remains on the photoconductive surface 15 after the transfer of the toner powder image to the final support material. The residual toner particles remaining on the photoconductive surface after the transfer operation is removed from the belt 14 by the cleaning station 46 which comprises a cleaning blade 47 in scrapping contact with the outer periphery of the belt 14 and contained within cleaning housing 48 which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present application to illustrate the general operation of an automatic electrostatographic copier 10 which can embody the sheet handling apparatus in accordance with the present invention.

The sheet handling apparatus in accordance with the present invention will be described with continued reference to FIG. 1 and additional reference to FIGS. 2–6. The sheet handling apparatus 51 comprises a platen cover 53 closely spaced off the platen glass together with the associated transport and drive mechanisms which includes a single narrow width endless belt 60 driven by support roll 64 and supported at the other end by support roll 63. The spacing between the platen cover and platen glass is such as to be as wide as possible without exceeding depth of focus for the optical system. Typically this is of the order of 0.7 to 1.3 millimeters. The single narrow width belt 60 has at least one frictional contact element 61 for contact with the sheet to be transported across the imaging platen 51. The single narrow width belt 60 is driven by motor 67 through gear 68 on the motor 67 and a gear 70 on driven support roller 64. In the sheet handling apparatus illustrated in FIG. 2, the belt 60 has two frictional contact elements 61 spaced apart by a distance more than the maximum dimension of the sheet to be transported so that the sheet being transported across the imaging platen toward the registration member will be transported by only one of the frictional contact elements.

At the inboard end of the sheet handling apparatus is a document input tray 56 having a fixed edge guide 57 and an adjustable edge guide 58 to support a stack of documents to be separated and fed across the imaging platen. During the separation operation a stack of documents is placed on the document tray 56 at the nip formed between the single narrow width belt 60 and the retard pad 66. As the belt traverses its transport path between roller 63 and 64 the frictional contact element will come in contact with the top document in the stack of documents in the document stacking tray and the retard pad under the belt will apply a restraining force to all but the top sheet. The frictional contact element applies a normal force to the top sheet separating the sheet from the remaining sheets in the stack of sheets and feeding it in a forward direction. Once separated from the remaining sheets in the stack of sheets the frictional contact element will transport the separated sheet in a forward direction across the viewing platen 52 to registration finger so that the lead edge abuts registration fingers 86. As the lead edge of the document being fed toward the registration fingers initiates contact with the registration fingers any skew that may be present in the document may be readily corrected by the document automatically deskewing by pivoting about the small frictional contact element. This is enabled because the small frictional contact element has a small contact area with the document being registered and accordingly there are no other significant impeding forces on rotation of the sheet during its registration operation. This is because all the normal forces are concentrated on a small area of the sheet which is in contact with the frictional contact element, it being noted that all other normal forces normally associated with belt platen transports have been eliminated by the use of a single frictional contact element. It has been found that this narrow width belt with a single frictional contact element provides sufficient normal force to separate a top sheet from a stack of sheets to be fed and transport them across the platen and still permit any deskewing during registration. As a result with only the single frictional contact element in contact with the document being fed any forces that resist deskewing are eliminated.

Once the document has been registered the machine controller will actuate the reproducing apparatus and the designated number of copies of the document on the platen 52 will be reproduced. Upon completion of making the required copies, the registration fingers are lifted in a manner to be discussed hereinafter and the single narrow width belt is once again activated with the frictional contact element feeding the document forward into a nip formed by takeaway foam rolls 99, in contact with platen 52 which in turn advances the document towards turn baffle 92 through an eject nip formed between driven eject roller 88 and eject backup roll 89 onto stacking tray 93. The takeaway foam rolls 99 are mounted on the same shaft 100 that the driven support roll is mounted and accordingly are driven when the single narrow width belt is driven. It is noted that motor 67 provides the driving force through gear 90 for the driven eject roll. Since the frictional contact element separates and feeds the top sheet from a stack of documents and the device turns the documents over once they have been reproduced, the sheet handling apparatus provides an n to one document feeder.

Figure 2:
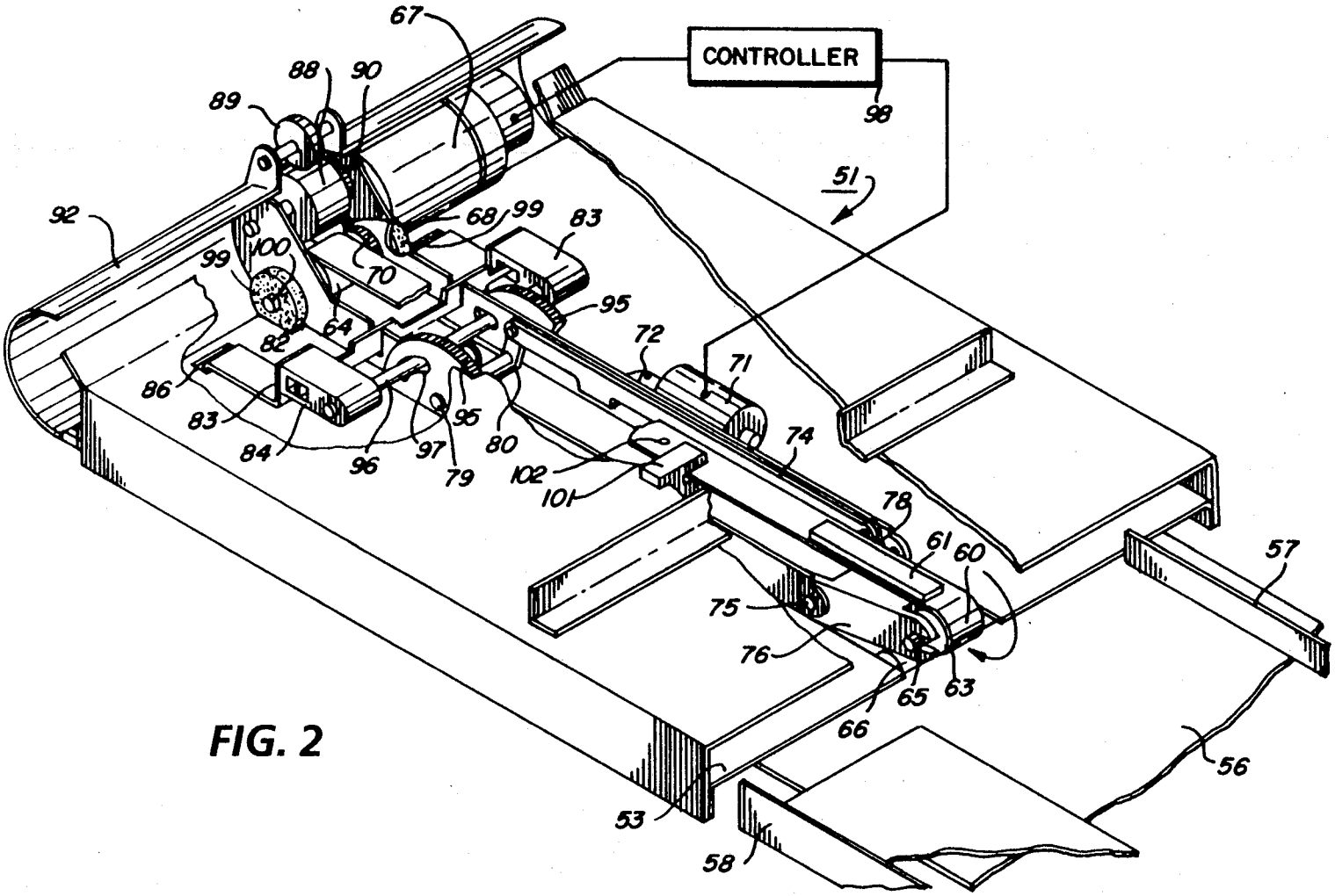
FIG. 2 is an isometric view partially cutaway of the sheet handling apparatus according to the present invention.
Figure 3:
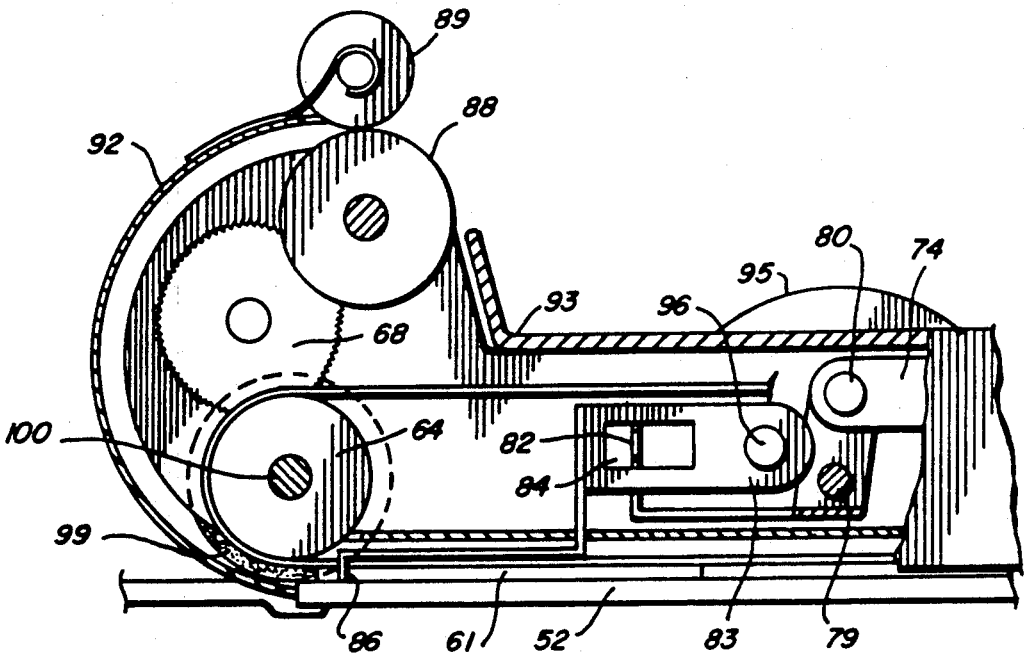
FIG. 3 is a side view of the outboard end of the sheet handling apparatus on top of the viewing platen of the automatic electrostatographic reproducing machine.
Figure 4:
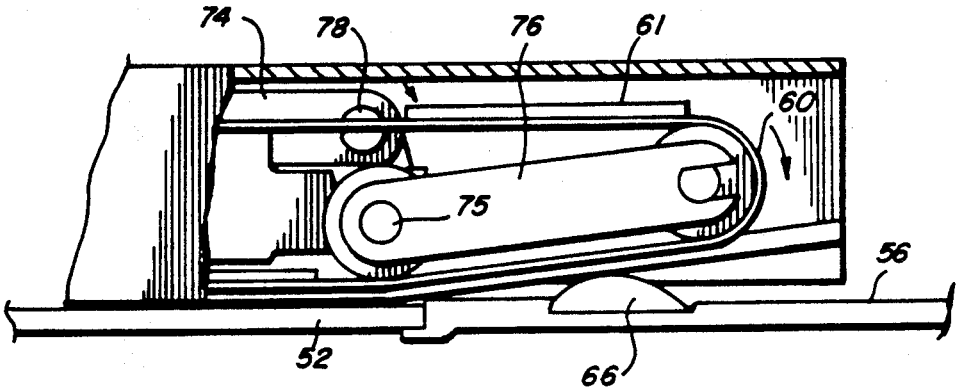
FIG. 4 is a side view of the inboard end or a sheet separation position of the sheet handling apparatus on top of the imaging platen of an automatic electrostatographic reproducing machine.
Figure 5:
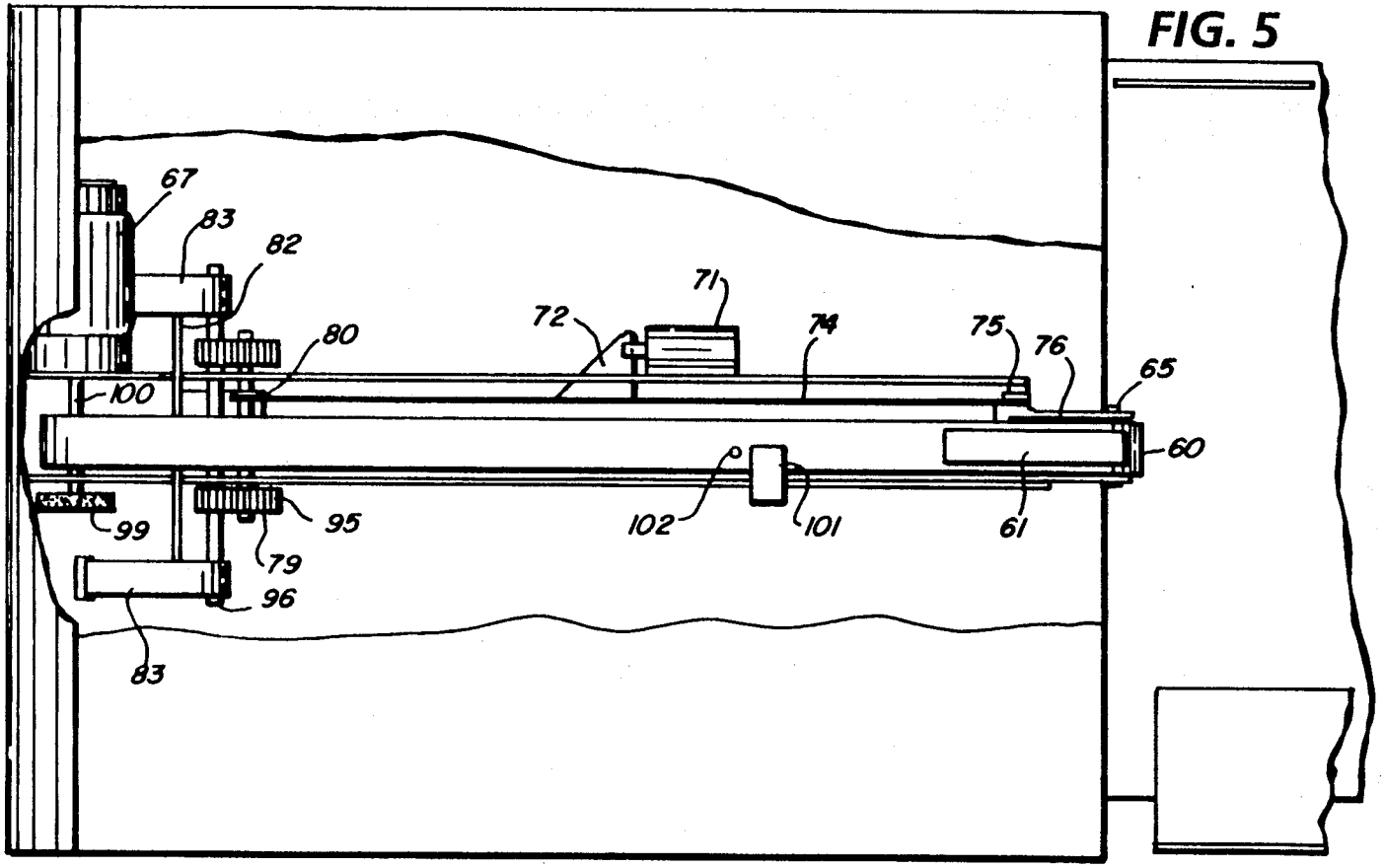
FIG. 5 is a top view partially cutaway of the sheet handling apparatus according to the present invention.

The sheet separation actuation mechanism and the registration actuation mechanism are controlled by solenoid 71, the plunger of which is connected to solenoid link 72 which in turn is connected to control arm 74. With particular reference to FIGS. 2 and 4, the document separation mechanism is illustrated wherein the end portion of the single narrow width belt support mechanism is arranged to articulate about pivot shaft 75 connected to pivoting carriage 76 which in turn is connected to shafts 65 about which support roller 63 is mounted. One end of the pivot carriage 76 is connected through support linkage 78 to the control arm 74 so that when the solenoid is actuated the control arm 74 is driven toward the document stack thereby pivoting the end of the single narrow width belt assembly down onto the stack of documents to be separated. As the belt rotates the frictional contact element 61 comes in contact with the top sheet in a stack of documents in the document tray and as discussed above, separates the top sheet therefrom and feeds it forward onto the imaging platen 52. At the same time through the control arm 74, the registration fingers 86 are lifted permitting the second frictional contact element to drive a document which already may be on the platen 52 to be driven into the nip formed between the takeaway foam rolls and the platen, into the turn baffle and through the eject rolls. In this regard attention is directed to FIG. 3 in addition to FIG. 2 for an understanding of the mechanism of actuating the registration fingers contained in two registration finger assemblies, one on each side of the belt. The registration fingers are supported by registration finger holders 83 which are pivotable about a shaft 96 and have a slot 84 in each holder. Entering both slots 84 is a one piece rigid registration lifting link 82 which is pivotally mounted about fixed shaft 79. The upper portion of the lifting links is connected to the control arm 74 by pin 80. When the solenoid is actuated the control arm is moved to the right thereby pivoting lifting link 82 upwardly which in turn rotates registration finger holders 83 upwardly thereby lifting the registration finger away from the lead edge of the document which has been registered. Accordingly, when the solenoid is actuated the feed head of the single narrow width belt pivots down so that its frictional contact element will contact the top document in the stack of documents in the sheet stacking tray while the registration fingers are retracted. Conversely when the solenoid is inactivated, the feed head of the single narrow width belt is pivoted counterclockwise so that the narrow width belt will be out of contact with the top document in the stack of documents and the registration fingers are once again placed in the registration position.

The exact positioning of both of the registration fingers 86 may be determined by two registration adjust thumb wheels 95 which are rotatably mounted on the shaft 79 and have cam surfaces 97 through which a shaft 96 supporting the registration finger holder is attached. Cam surfaces 97 enable one to adjust the location of the shaft 96 thus adjusting the registration position of each of the registration fingers 86 and thereby ensure accurate registration. This is accomplished merely by an operator manually rotating the thumb wheel 95 so that the position of the shaft 96 is adjusted by the cam surface to provide the desired location for the registration fingers 86.

The actuation of the sheet handling apparatus together with the operation of the reproducing apparatus is controlled by a suitable control mechanism such as controller 98 as is well known in the art. In operation, a stack of sheets is placed on the document stacking tray and the document handler actuated. Upon actuation the single narrow width belt is driven by motor 67 and the solenoid is actuated moving control arm 74 to the right in FIG. 2 thereby forcing the feeding head of the single narrow width belt downwardly so the frictional contact element can come in contact with the top document in the stack of documents thereby separating it from the remaining documents in the stack as it traverses its path. Simultaneously the control arm 74 rotates the linkage 80 so that it pivots about fixed shaft 79 and raises the lifting link 82 thereby raising the registration finger holders to raise the registration fingers 86. With continued movement of the single narrow width belt the single frictional contact element in contact with the sheet separated from the stack of sheets drives it across the platen by contact only with the single frictional contact element toward the registration edge. Once the sheet has been separated from the stack of sheets and is well on its way, the solenoid is deactivated thus retracting the feeding head of the single narrow width belt to the non feeding position and rotating the registration fingers to the registration position. The motor 67 is deactivated thereby stopping movement of the belt by the controller in response to a stationary optical sensor 101 sensing a hole 102, see FIGS. 2 and 5, in the belt as it passes the sensor and permitting a further fixed amount of belt movement to bring the leading edge of the sheet to the registration position. When the leading edge of the sheet being fed by the single frictional contact element in contact therewith comes in contact with the first registration finger it will tend to pivot about the registration finger to remove any skewing in the documents so that the lead edge is registered against both registration fingers in the proper orientation. This is enabled because all the normal forces are concentrated on the small area of contact between the single frictional contact element and the sheet thereby enabling the remaining portion of the sheet to pivot thereabout in order to be deskewed. When the leading edge of the sheet reaches the registration fingers the motor is turned off. After the desired number of copies of the document on the viewing platen have been made the motor 67 is once again actuated as is the solenoid 71 thereby raising the registration fingers at one end of the viewing platen and initiating the rotating of the feeding head of the single narrow width belt to the separation/feeding position with a frictional contact element coming into contact with the next document in the stack of sheets to be copied.

Figure 6:
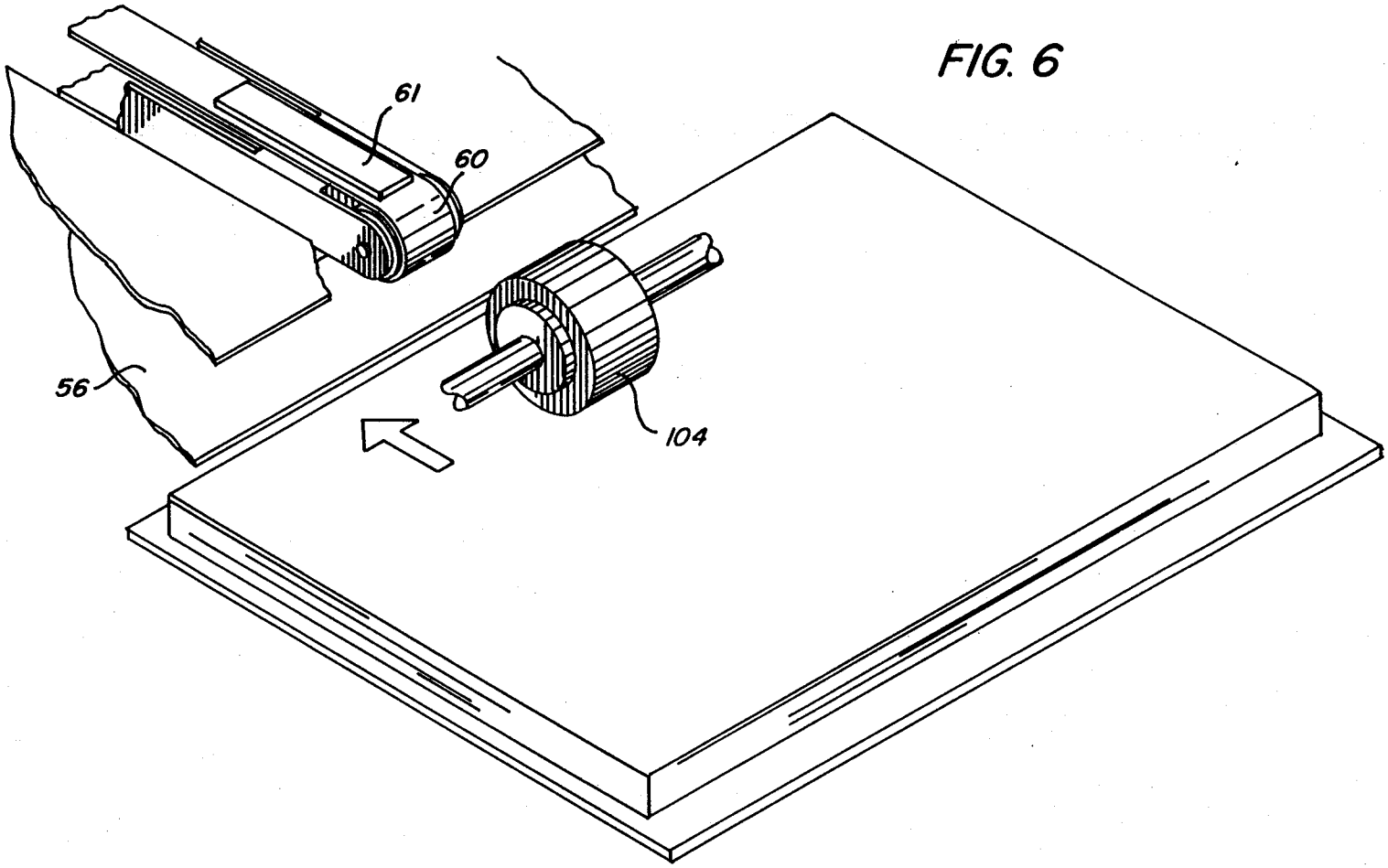
FIG. 6 is an isometric view of an alternative embodiment of the sheet handling apparatus according to the present invention.

While the sheet handling apparatus has been illustrated as a combination of a sheet separator, transport, registering and deskewing device it will of course be understood that it can be employed purely for the transport, registration and deskewing function. This may be accomplished as illustrated in FIG. 6 wherein a separate independent feed mechanism such as feed roll 104 feeds the top sheet from a stack of sheets into the document transporting device. It will be noted in this instance that there is no necessity for the feeding head of the single narrow width belt to be articulated between the separation position and a non-separation position. Also, it will be noted that individual sheets could be placed one at a time on platform 56 for semi-automatic operation.

The belt is typically very narrow compared to the width of the viewing platen and may have the raised frictional contact element molded therein or adhesively fixed thereto. Typical belt widths are of the order of about 2 to about 5 cm and the contact element provides a frictional contact area of about 1 to about 20 square centimeters. The frictional contact area is a very small area relative to size of the sheet and is as small as possible to minimize all frictional forces which inhibit deskewing while providing the friction drive force necessary or sufficient to drive a sheet across the platen. The belt and contact element may be made of any suitable material such as silicone rubber which provides a suitable frictional relationship with the sheets upon which it operates.

Accordingly the present invention provides a simple, low cost sheet handling apparatus which is capable of providing multiple functions including sheet separation, transport, registration and deskewing. It has the particular advantage in addition to reduced cost that it enables accurate deskewing of a sheet being registered while minimizing the danger of damage to the lead edge of the sheet or other portions of the sheet since the feeding contact between the feeding device and the sheet is absolutely minimal and provides a pivot about which the sheet can pivot to provide the necessary deskewing. Furthermore this enables a transporting and registration system which is much less sensitive since the sheet is only driven about a single small area. This is in contrast to the typical wide friction belt where you need to control the friction so that you have enough to transport the sheet and yet be low enough to provide slippage during registration and deskewing. The sheet handling apparatus has the additional advantage of enhanced reliability in that it is operated with relatively few electromechanical devices which can malfunction. Additionally, since the belt is narrow, conventional and simple means can be used for belt tracking such as crowned rolls, thus eliminating the expense of belt steering mechanisms often required for wide friction belts. Given this simplified means for belt tracking, further cost reductions are possible since the need for precision tolerances on such things as shaft and support roll parallelism, mechanisms to conform the wide belt to the platen, etc., are not required. Further, the cost of the belt itself is substantially reduced from the wide friction belt.

The disclosures of the patents referred to herein are hereby specifically and totally incorporated herein by reference.

While the invention has been described with reference to specific embodiments it will be apparent to those skilled in the art that many alternatives, modifications and variations may be made. For example, the sheet handling apparatus may be fixed on the platen as described or pivotally mounted on the reproducing apparatus about an edge to permit manual placement of the document, including books, on the platen for reproduction. Accordingly it is intended to embrace all such alternatives and modifications as may fall within the spirit and scope of the appended claims.

What is claimed is:

1. Sheet handling apparatus for transporting, registering and deskewing sheets comprising a flat surface having inboard and outboard ends across which sheets may be transported, a registration stop member at the outboard end of said flat surface, a single endless narrow width belt movably supported around at least two support means to define a belt transport run across and parallel to said flat surface, said single narrow width belt having at least one raised frictional contact element on its outer run for frictional transporting engagement with a sheet to be transported across said flat surface toward said registration stop member, said at least one raised frictional contact element on said belt having a frictional contact area very small relative to the size of the sheet to be transported to minimize frictional forces which inhibit sheet deskewing while being sufficient to provide a friction drive force to drive a sheet across the flat surface and being positioned such that a sheet being transported across said flat surface toward said registration member is transported by only one of said at least one frictional contact element thereby providing a single pivot about which a sheet may pivot when it reaches the registration stop member to be deskewed.

2. The sheet handling apparatus of claim 1, wherein said raised frictional contact elements project substantially normally to the belt surface.

3. The sheet handling apparatus of claim 1, wherein said flat surface comprises the imaging platen of an electrostatographic printing machine.

4. The sheet handling apparatus of claim 1, wherein said frictional contact area is from about 1 to about 20 square centimeters.

5. The sheet handling apparatus of claim 1, including means to reciprocally move said registration stop member from a registration position to a position retracted from said registration position.

6. The sheet handling apparatus of claim 5, wherein said raised frictional contact element on said belt ejects the leading edge of a sheet from said flat surface when said registration stop member is in the retracted position and further including at least one sheet takeaway means in contact with said flat surface adjacent said registration stop member to transport a sheet through a sheet turn baffle to sheet eject rolls which transport a sheet to a sheet stacking tray positioned above said belt transport run.

7. The sheet handling apparatus of claim 1 wherein said at least one raised frictional contact element comprises at least two elements, said elements being spaced apart by a distance more than the maximum dimension of a sheet to be transported.

8. Sheet handling apparatus for separating sheets from a stack and transporting, registering and deskewing individual separated sheets comprising a single endless narrow width belt movably supported around at least two support means defining a path from a sheet separation/feeding station through a sheet transport run to a sheet registration station;

said single narrow width belt having at least one raised frictional contact element on its outer run for frictional engagement with a sheet, a sheet stack support platform at the sheet separation/feeding station, a friction retard pad on said support platform and under the separation/feeding station of said belt forming a sheet separating nip therebetween, a flat surface having inboard and outboard ends across which separated sheets may be transported, a registration stop member at the outboard end of said flat surface, means to reciprocally support one of said support means at the sheet separation station between a sheet separation position wherein a raised frictional contact element on said belt contacts the top sheet of a stack of sheets when a stack of sheets is present and a position retracted from the sheet separation position;

said at least one raised frictional contact element on said belt having a frictional contact area very small relative to the size of the sheet to be transported to minimize frictional forces which inhibit sheet deskewing while being sufficient to provide a friction drive force to drive a sheet across the flat surface and being positioned such that a sheet being separated from a stack of sheets is contacted at said separation nip by only one of said at least one frictional contact elements and is transported across said flat surface toward said registration member by the same frictional contact element thereby providing a single pivot about which a sheet may pivot when it reaches the registration stop member to be deskewed.

9. The sheet handling apparatus of claim 8, wherein said raised frictional contact elements project substantially normally to the belt surface.

10. The sheet handling apparatus of claim 8, wherein said flat surface comprises the imaging platen of an electrostatographic printing machine.

11. The sheet handling apparatus of claim 8, wherein said frictional contact area is from about 1 to about 20 square centimeters.

12. The sheet handling apparatus of claim 8, including means to reciprocally move said registration stop member from a registration position to a position retracted from said registration position.

13. The sheet handling apparatus of claim 12, wherein said means to reciprocally move said support means and said registration member are interconnected so that when said support means is in the separation/feeding position said registration stop member is in the retracted position.

14. The sheet handling apparatus of claim 12, wherein said raised frictional contact element on said belt ejects the leading edge of a sheet from said flat surface when said registration stop member is in the retracted position and further including at least one sheet takeaway member to transport a sheet through a sheet turn baffle to sheet eject rolls which transport a sheet to a sheet stacking tray positioned about said transport run.

15. The sheet handling apparatus of claim 8 wherein said at least one raised frictional contact element comprises at least two elements, said elements being spaced apart by a distance more than the maximum dimension of a sheet to be transported.

* * * * *